US005635945A

United States Patent [19]

McConnell et al.

[11] Patent Number: 5,635,945

[45] Date of Patent: Jun. 3, 1997

[54] QUADRIFILAR HELIX ANTENNA

[75] Inventors: Richard J. McConnell, Rancho Cucamonga; James C. Nicoles, Santa Clarita; Gary S. Barta, Duarte, all of Calif.

[73] Assignee: Magellan Corporation, San Dimas, Calif.

[21] Appl. No.: 445,881

[22] Filed: May 12, 1995

[51] Int. Cl.[6] ..... H01Q 1/36; H01Q 1/38

[52] U.S. Cl. ..... 343/895; 343/860

[58] Field of Search ..... 343/895, 700 MS, 343/893, 860, 862, 863, 865, 853, 850, 859; H01Q 1/36, 1/38

[56] References Cited

U.S. PATENT DOCUMENTS

| | | | |
|---|---|---|---|
| 3,534,378 | 10/1970 | Smith, Jr. | 343/828 |
| 3,623,113 | 11/1971 | Falgen | 343/747 |
| 3,906,514 | 9/1975 | Phelan | 343/895 |
| 4,008,479 | 2/1977 | Smith | 343/895 |
| 4,148,030 | 4/1979 | Foldes | 343/895 |
| 4,349,824 | 9/1982 | Harris | 343/700 |
| 4,554,554 | 11/1985 | Olsen et al. | 343/895 |
| 5,134,422 | 7/1992 | Auriol | 343/895 |
| 5,138,331 | 8/1992 | Josypenko | 343/895 |
| 5,170,176 | 12/1992 | Yasunaga et al. | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,346,300 | 9/1994 | Yamamoto et al. | 343/895 |
| 5,349,365 | 9/1994 | Ow et al. | 343/895 |

OTHER PUBLICATIONS

Kilgus, "Resonant Quadrafilar Helix", IEEE, AP–17, pp. 349–351, May 1969.

Kilgus, "Radiation Pattern Performance of the Backfire Quadrifilar Helix", IEEE AP article, 1975, pp.392–397.

Adams et al., "The Quadrifilar Helix Antenna", IEEE, AP–22 Mar. 1974, pp. 173–178.

Keen, "Developing a Standard–C Antenna", Design Note, MSN & CT Jun. 1988, pp. 52 & 54.

Shuhao, "The Balun Family", Microwave Journal, Sep. 1987, pp. 227–229.

Tranquilla et al., "A Study of the Quadrifilar Helix Antenna . . . ", IEEE AP vol. 38, Oct. 1990, pp. 1550–1559.

Woodward et al., "Balance Quality Measurements on Baluns", IEEE MTT vol.31, Oct. 1983, pp. 821–824.

*Primary Examiner*—Hoanganh T. Le

*Attorney, Agent, or Firm*—Philip T. Virga

[57] ABSTRACT

A quadrifilar helix antenna for use in satellite communications comprises four conductive elements arranged to define two separate helically twisted loops, one slightly differing in electrical length than the other, to define a cylinder of constant radius supported by itself or by a cylindrical non-conductive substrate. The two separate helically twisted loops are connected to each other in such a way as to constitute the impedance matching, electrical phasing, coupling and power distribution for the antenna. In place of a conventional balun, the antenna is fed at a tap point on one of the conductive elements determined by an impedance matching network which connects the antenna to a transmission line. The matching network can be built with distributed or lumped electrical elements and can be incorporated into the design of the antenna.

20 Claims, 5 Drawing Sheets

QUADRIFILAR HELIX ANTENNA

BACKGROUND OF THE INVENTION

This invention generally relates to quadrifilar helix antennas used for radiating or receiving circularly polarized waves. More particularly, this invention relates to an improved feed system for coupling signals of equal magnitude and 90 degrees out of phase to one end of the antenna.

It is well known that helical antennas comprising a plurality of resonant elements arranged around a common axis are particularly useful in ground links with orbiting satellites or in mobile/relay ground links with geosynchronous satellites. Due to the arrangement of the helical elements, the antenna exhibits a dome-shaped spatial response pattern and polarization for receiving signals from satellites. This type of antenna is disclosed in "Multielement, Fractional Turn Helices" by C. C. Kilgus in IEEE Transactions on Antennas Propagation, July 1968, pages 499 and 500. This paper teaches, in particular, that a quadrifilar helix antenna can exhibit a cardioid characteristic in an axial plane and be sensitive to circularly polarized emissions.

One type of prior art helical antenna comprises two bifilar helices arranged in phase quadrature and coupled to an axially located coaxial feeder via a split tube balun for impedance matching. While antennas based on this prior design are widely used because of the particular response pattern, they have the disadvantage that they are extremely difficult to adjust in order to achieve phase quadrature and impedance matching, due to their sensitivity to small variations in element length and other variables, and that the split tube balun is difficult to construct. As a result, their manufacture is a very skilled and expensive process.

Therefore, there is a need for a quadrifilar helix antenna having a predetermined input impedance which could be manufactured on a production basis without the need for adjustment and costly individual tuning. Further, there is a need to provide a quadrifilar helix antenna having a simplified feed arrangement that avoids the complexities of conventional folded, stepped or split shield baluns.

The subject invention herein solves all of these problems in a new and unique manner which has not been part of the art previously. Some related patents are described below:

U.S. Pat. No. 5,191,352 issued to S. Branson on Mar. 2, 1993

This patent is directed to a quadrifilar antenna comprising four helical wire elements shaped and arranged so as to define a cylindrical envelope. The helical wires are mounted at their opposite ends by first and second printed circuit boards having coupling elements in the form of plated conductors which connect the helical wires to a feeder or semi-rigid coaxial cable on the first board, and with each other on the second board. The conductor tracks are such that the effective length of one pair of helical wires and associated impedance elements is greater than that of the other pair of helical wires, so that phase quadrature is obtained between the two pairs.

U.S. Pat. No. 4,008,479 issued to V. C. Smith on Feb. 15, 1977

This patent is directed to a dual-frequency circularly polarized antenna. The antenna comprises a longitudinal cylindrical non-conductive member supported at its top by four conductors each extending transversely from a center coaxial line. Two sets of the antenna conductors are attached to the non-conducting cylinder in a configuration of equally longitudinally spaced spirals. The two sets of conductors are conductively connected by pins such that one set corresponds to a half wavelength at one frequency and the other set corresponds to a half wavelength at another frequency.

U.S. Pat. No. 3,623,113 issued to I. M. Falgen on Nov. 23, 1971

This patent is directed to a tunable helical monopole antenna. The tunable helical monopole antenna comprises a winding having both an upper portion and a lower portion which are symmetrically substantially identical to each other. Connected to each end of the winding halves are cylindrical terminal dipole elements and connected to these terminal elements are shorting fingers. By synchronously moving the shorting fingers, the respective helical windings are effectively shorten or lengthen for tuning purposes.

U.S. Pat. No. 5,255,005 issued to C. Terret et al. on Oct. 19, 1993

This patent is directed to a dual layer resonant quadrifilar helix antenna. The antenna comprises a quadrifilar helix formed by first and second bifilar helices positioned orthogonally and excited in phase quadrature. Additionally, a second quadrifilar helix is coaxially and electromagnetically coupled to a first quadrifilar helix.

U.S. Pat. No, 4,148,030 issued to P. Foldes on Apr. 3, 1979

This patent is directed to a combination helical antenna comprising a plurality of tuned helical antennas which are coaxially wound upon a hollow cylinder, whereby the antennas are collocated. The antenna further comprises a printed circuit assembly having thin metal dipoles of the type used in a microwave strip line. The thin metal dipoles are resonating elements that are coupled to each other in a manner similar to end-fire elements of a microstrip filter.

While the basic concepts presented in the aforementioned patents are desirable, the apparatus employed by each to produce a quadrifilar helix antenna are mechanically far too complicated to render them as an inexpensive means of achieving an antenna having a predetermined input impedance which could be manufactured on a production basis without the need for adjustment and costly individual tuning and still present desired radiation characteristics during operation.

SUMMARY OF THE INVENTION

A quadrifilar helix antenna for use in satellite communications comprises four conductive elements arranged to define two separate helically twisted loops, one slightly differing in electrical length than the other, to define a cylinder of constant radius supported by itself or by a cylindrical non-conductive substrate. The two separate helically twisted loops are connected to each other in such a way as to constitute the impedance matching, electrical phasing, coupling and power distribution for the antenna. In place of a conventional balun, the antenna is fed at a tap point on one of the conductive elements determined by an impedance matching network which connects the antenna to a transmission line. The matching network can be built with distributed or lumped electrical elements and can be incorporated into the design of the antenna.

Therefore, it is an object of the present invention to provide a simple matching network where the inductance of the conductor leading to the tap point is tuned out by a series capacitor before connecting to the transmission line used to transfer radio frequency signals to and from the antenna.

An object of the present invention is to provide a quadrifilar antenna formed by two bifilar helices where the coupling between the two helices is provided by a shared common current path.

A further object of the present invention is to have a quadrifilar antenna which has a simple feed method that does not require the use of conventional folded, stepped or split shield baluns.

Another object of the present invention is to provide a quadrifilar antenna formed by printed circuit boards which can be relatively accurately formed with predetermined shapes and dimensions, such that relatively little, if any, adjustment is required to obtain an antenna having the required electrical characteristics.

Yet, still another object of the present invention is to have a quadrifilar antenna which can be mass-produced to precise dimensions with high reproducibility of electromagnetic characteristics.

Still, yet another object of the present invention is to provide a quadrifilar antenna which is especially simple in construction, particularly light weight and compact in design.

A further object of the present invention is to provide a low cost antenna having a quasi-hemispherical radiation pattern of the type formed by two bifilar helices used in ground and orbital satellite telecommunication links or in mobile relay telecommunication links with geosynchronous satellites.

Accordingly, it is an object of the present invention to provide an effective, yet inexpensive and relatively mechanically unsophisticated quadrifilar antenna, which is rugged yet lightweight, easily carried and used.

BRIEF DESCRIPTION OF THE DRAWINGS

The above, as well as other, advantages of the present invention will become readily apparent to those skilled in the art from the following detailed descriptions of the preferred embodiment when considered in light of the accompanying drawings in which.

DESCRIPTION OF THE PREFERRED EMBODIMENTS

Figure 1:
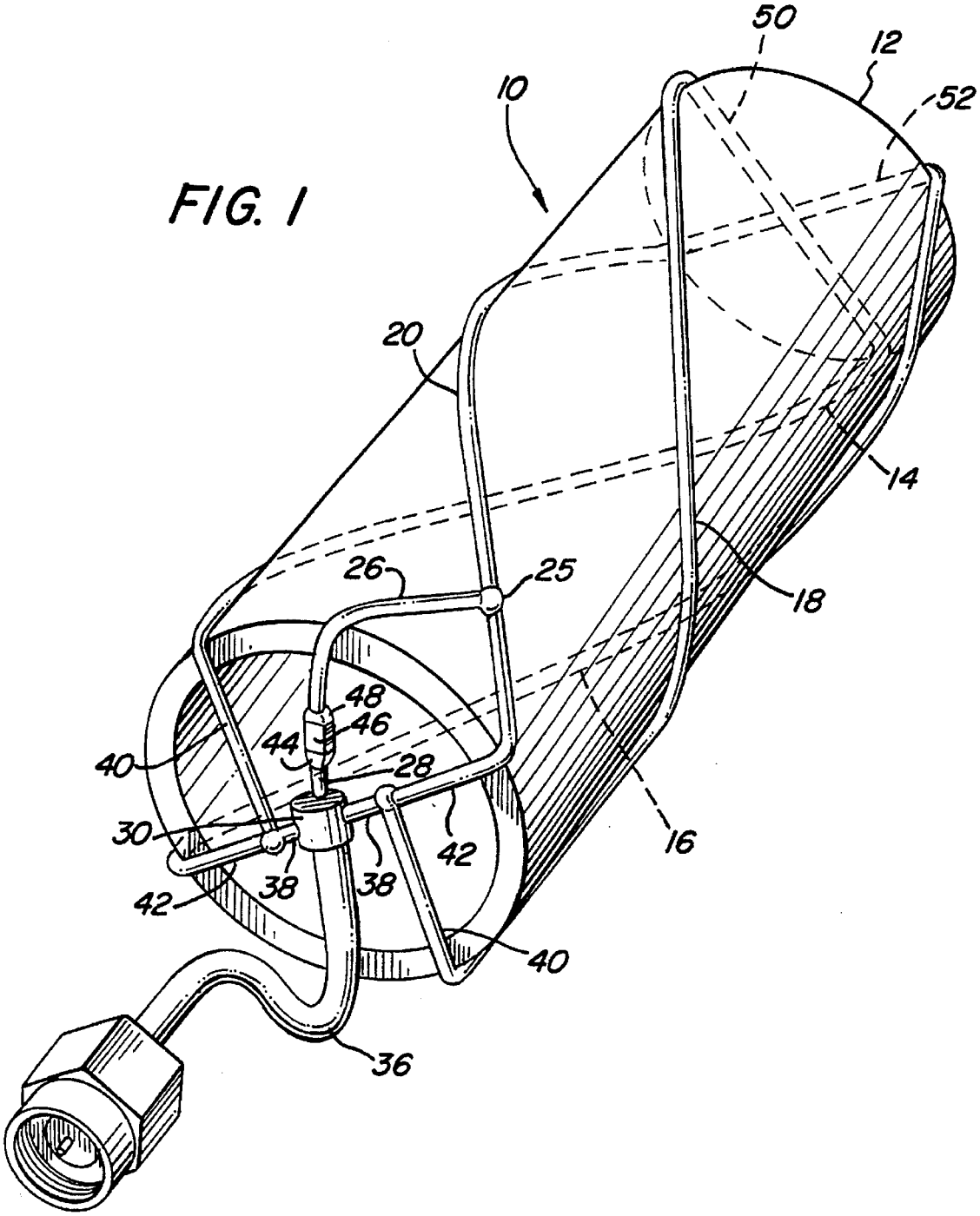
FIG. 1 is a perspective view of a quadrifilar helix antenna in accordance with the present invention.

Referring now to the drawings wherein like reference numerals refer to like and corresponding parts throughout, the quadrifilar antenna in accordance with the present invention is generally indicated by numeral 10. Referring to FIGURE the quadrifilar antenna 10 comprises a generally elongated non-conducting cylindrical support tube 12 having four conductive elements 14, 16, 18 and 20 supported on an outer surface of tube 12 so as to make the antenna 10 right-hand or left-hand circularly polarized. Although not shown, it should be envisioned that the elements 14, 16, 18 and 20 could be self-supporting without tube 12 by the use of rigid wire or could be arranged against the inner surface of tube 12.

Referring once again to FIG. 1, elements 14 and 18 are cross connected by shorting conductor 50, and elements 16 and 20 are cross connected by shorting conductor 52. A first helix is thus formed by elements 14 and 18, conductor 50 and equal conductors 40 which are slightly longer than a second helix formed by elements 16 and 20, conductor 52 and equal conductors 42. Therefore, the first and second helices have two different electrical lengths translating into two different resonant frequencies which are chosen by design to result in an electrically 90° phase difference between the currents induced in each helix loop thus maintaining phase quadrature. The common section 38 shared by each helix loop provides the coupling from the driven helix formed by elements 16 and 20, conductor 52 and equal conductor 42 to the other helix formed by elements 14 and 18, conductor 50 and equal conductor 40.

Turning once again to FIG. 1, a coaxial transmission line 36 has its inner conductor 28 connected at one end 44 of a capacitor 46 whose other end 48 connects through a conductor 26 to a tap point 25 on element 20 to effectively impedance match antenna 10 without the use of a conventional balun. The placement and value of capacitor 46 and length and tap point of conductor 26 are predetermined from the desired input impedance presented by transmission line 36. Although transmission line 36 is shown as coaxial, it may be any variety of transmission lines used to carry radio frequency signals. Therefore, the capacitor 46 is used to tune out the inductance of conductor 26 at the antenna frequency. An outer conductor 30 of transmission line 36 connects to the midpoint of common conductor section 38. The shape of the antenna 10 may be cylindrically round or square or may be tapered over its length without altering the intent of the invention.

It is understood by those familiar with the art that any method of feeding the antenna 10 with a variety of unbalanced transmission lines in addition to coaxial, such as microstrip or strip line can be accomplished by connecting the signal line to the capacitor 46 at capacitor end 44 and the ground or signal return side to the midpoint of shared common segment Altough not shown, it may be envisioned that the antenna 10 may be fed with a balanced transmission line in a differential fashion as follows: A duplicate capacitor 46 and connecting conductor 26 as shown in FIG. 1, are connected to conductive element 20 and added in addition to those shown in a like and identical manner to conductive element 16 at a tap point 25 identical to that as shown for element 20. Each wire of the balanced transmission line would than connect individually and separately to each of the ends 44 of capacitors 46.

It is also understood by those skilled in the art, that a transmission line is a common and practical way of transferring radio frequency electrical signals between circuits and antennae and is used herein as an example of how the invention can be utilized. Thus the invention described here could be placed very near to nearby circuits or on printed circuit boards directly where the coupling of signals to the antenna can be accomplished without the need for a conventional transmission line.

Figure 2:
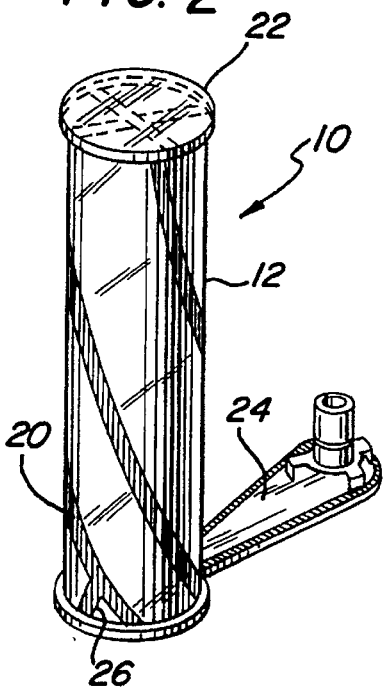
FIG. 2 is a perspective view of one preferred embodiment of the quadrifilar helix antenna in accordance with the present invention.

Referring now to the drawings, and more particularly to FIG. 2, another preferred embodiment of the quadrifilar antenna 10 comprises a generally elongated longitudinal cylindrical substrate 12 having the four conductive elements 14, 16, 18 and 20 supported on its outer surface and having mounted at opposite ends two printed circuit boards 22 and 24. As shown in FIG. 2, the conductive elements 14, 16, 18 and 20 respectively, are arranged helically around the outer surface of the substrate 12 so as to make the antenna 10 right-hand circularly polarized. Although not shown, it should be envisioned that the antenna 10 could similarly be left-hand circularly polarized.

In the preferred embodiment, the cylindrical substrate 12 is made from a non-conductive material such as glass, fiberglass or the like, having a dielectric constant that corresponds to the width, length and material of the conductive elements 14, 16, 18 and 20, respectively. Using higher dielectric materials can result in significant shortening of the phsyical antenna structure. The cylindrical structure 12 can be formed as a tube or a flat structure rolled into a tubular shape and may have a cross section which is either circular or square. However, it should be well understood that the substrate or material can be varied without deviating from the teachings of the subject invention. The conductive elements 14, 16, 18 and 20, respectively, may be made from copper, silver or like metals and are metal plated onto the substrate 12 by any type of coating technique known in the metallic plating arts.

Figure 3:
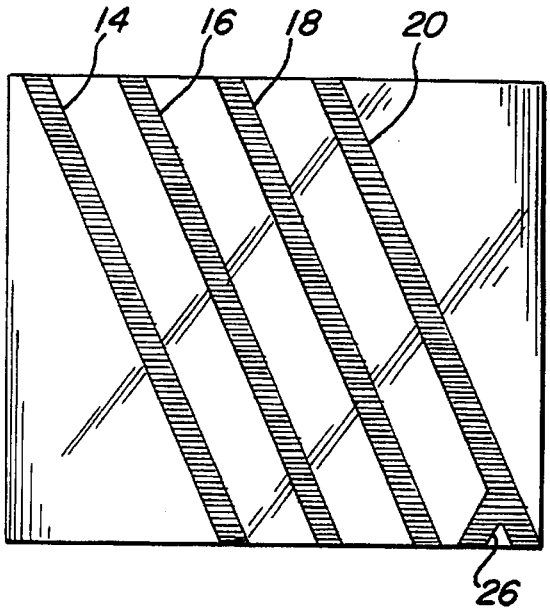
FIG. 3 is plan view of the conductive elements shown in FIG. 2.

Turning now to FIG. 3, the conductive elements 14, 16, 18 and 20, respectively, are shown in a plane in order to further distinguish certain characteristics unique to the subject invention. As shown in FIGS. 2 and 3, the conductive elements 14, 16, 18 and 20, respectively, are parallel and substantially equally transversely spaced from each other when plated onto the substrate 12. However, in place of a conventional balun, a feed line 26 is supported on the substrate 12 and is electrically connected to one of the conductive bands 20 at one end and is electrically connected to the printed circuit board 24 at the other end, as will be more fully described below. The location of the feed line 26 is predetermined from the desired input impedance and results in the antenna 10 being manufactured on a production basis without the need for adjustment and costly individual tuning by avoiding the complexities of conventional folded, stepped or split shield baluns.

Figure 4:
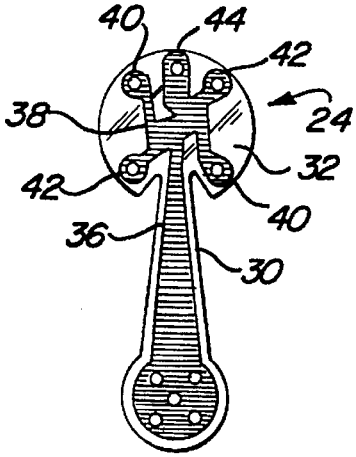
FIG. 4 is a top plan view of a one side of a first printed circuit board of the antenna of the present invention.
Figure 5:
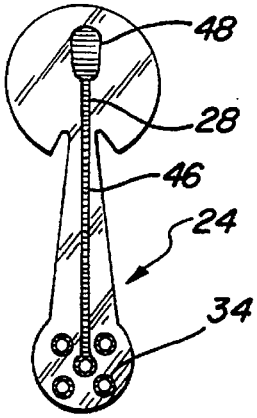
FIG. 5 is a top plan view of a second side of the printed circuit board shown in FIG. 4.

Referring now to FIGS. 4 and 5, there is shown a first side 32 and second side 34 of the printed circuit board 24, which is used to perform both the power distribution and impedance matching for the antenna 10. The printed circuit board 24 comprises microstrip line 28 over conducting ground plane 30 formed on each side of the board 24, wherein the microstrip structure of 28 and 30, respectively, are electrically coupled to each other to form a microstrip transmission line 36 which serves the same purpose as transmission line 36 in FIG. 1. Turning now to FIG. 4, the ground plane 30, on the first side 32 of the board 24 comprising transmission line 36 terminates into the midsection of a generally rectangular portion 38, the common section coupling the two helices, centered on the board 24. The rectangular portion 38 has a first set 40 and a second set 42 of connecting lines, each set of connecting lines 40 and 42, being electrically connected to a respective one of the conducting elements 14, 16, 18 and 20, serving the same purpose as described in FIG. 1. For electrical characteristic purposes, such as frequency bandwidth, the first set 40 of the connecting lines have a different electrical length, translating into two different resonant frequencies, than the second set 42 of connecting lines, and is a matter of design choice. Even though in the preferred embodiment, the connecting lines are shown as straight, it may be envisioned that the connecting lines may also meander to obtain longer electrical lengths as may the conductors 14, 16, 18 and 20, respectively.

As shown in FIG. 4, on the first side 32 of the board 24 is formed a first capacitive element 44 separated from the rectangular portion 38 and the first set 40 and second set 42 of connecting lines. Referring now to FIG. 5, on the second side 34 of the board 24 is a microstrip line 28 which terminates into a second capacitive element 48. Elements 44 and 48 on each side of board 24 form a parallel plate capacitor whose function is the same as capacitor 46 in FIG. 1. As shown in FIGS. 4 and 5, the transmission line 36 inwardly tapers to connect to the rectangular portion 38 and second capacitive element 48 on the second side 34 of the board 24, wherein the transmission line 36 is tapered solely for mechanical reasons for bending the flexible printed circuit board 24 away from the conductive elements 14, 16, 18 and 20, respectively, and further does not interfere with the antenna radiation pattern. Typically, in the preferred embodiment the transmission line 36 will have an impedance of 50 ohms allowing the antenna 10 to be fed by a BNC connector or coaxial connector.

Figure 6:
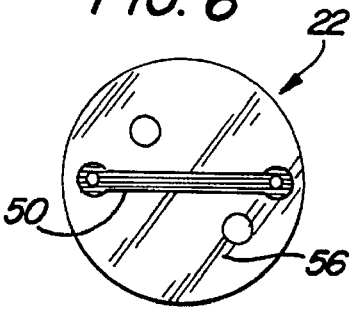
FIG. 6 is a top plan view of one side of a second printed circuit board of the antenna of the present invention.
Figure 7:
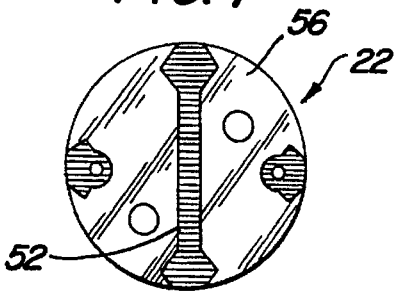
FIG. 7 is a top plan view of a second side of the printed circuit board shown in FIG. 6.

Referring now to FIGS. 3 through 5, as mentioned above, the feed line 26 supported by the substrate 12 is electrically connected to the conductive band 20 at the tap point 25 and is electrically connected to the first capacitive element 44 at the other end. The feed line 26 has a predetermined shape and position to impedance match the antenna 10 in association with the first capacitive element 44 which electrically couples to the second capacitive element 48 wherein the first and second capacitive elements, 44 and 48 respectively, have predetermined dimensions for matching out the inductance of the feed line Turning now to FIGS. 6 and 7, the printed circuit board 22 comprises a first shorting line 50 formed on one side 54 of the board 22 and a second shorting line 52, oppositely formed on the other side 56. The first shorting line 50 is connected to a first set of two of the oppositely disposed conductive elements 14 and 18, on the outer surface of the substrate 12, wherein the second shorting line 52 is similarly connected to the second set of oppositely disposed conductive elements 16 and 20, also located on the outer surface of the substrate 12. All the electrical connections from the conducting elements 14, 16, 18 and 20, respectively, to the conductive elements on circuit board 22 and 24 may be accomplished by soldering or other electrical attachment means known in the art.

Figure 8:
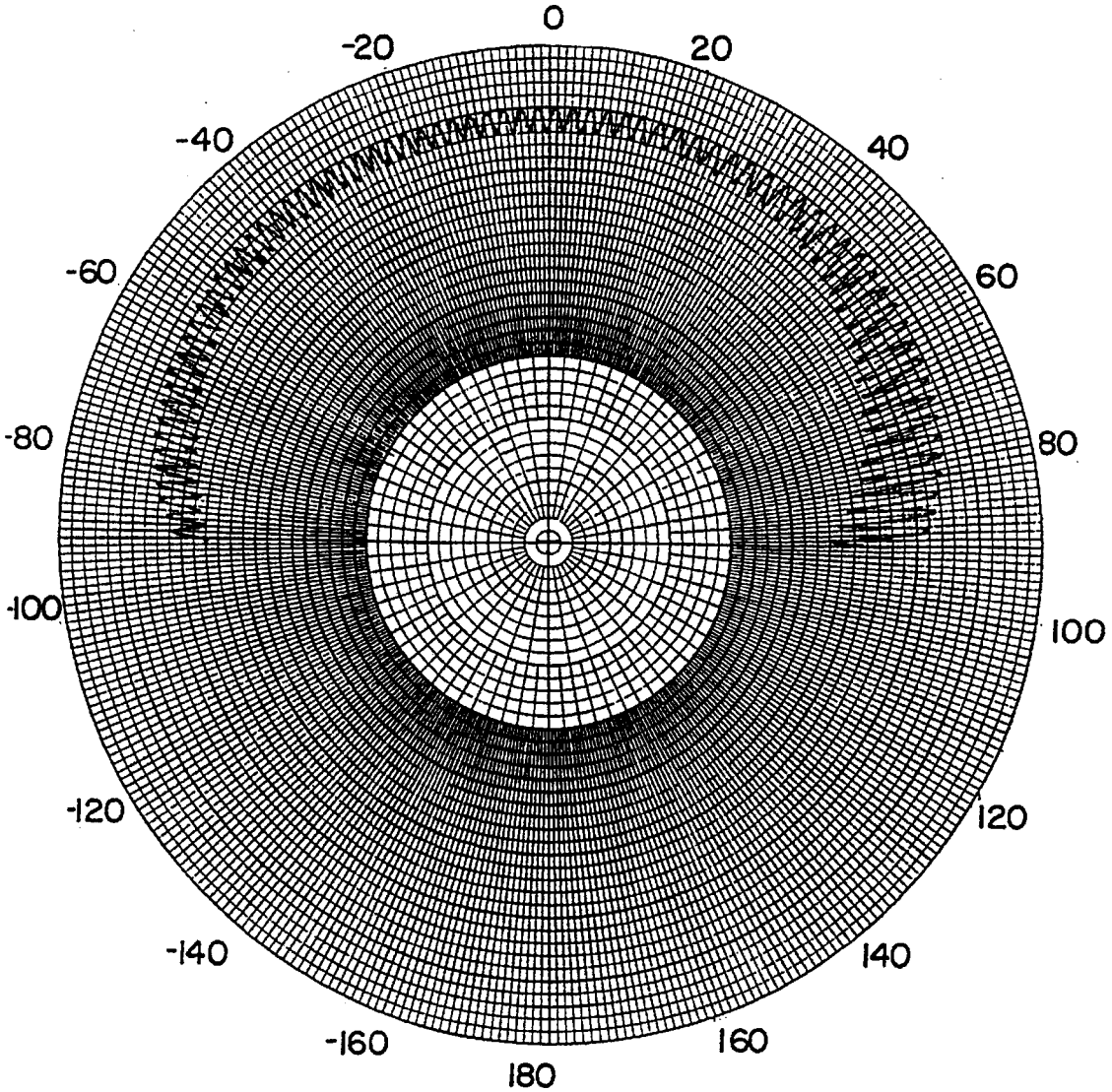
FIGS. 8, 9, 10 respectively represent the radiation pattern and value of VSWR of an antenna built in accordance with the teachings of the present invention.
Figure 9:
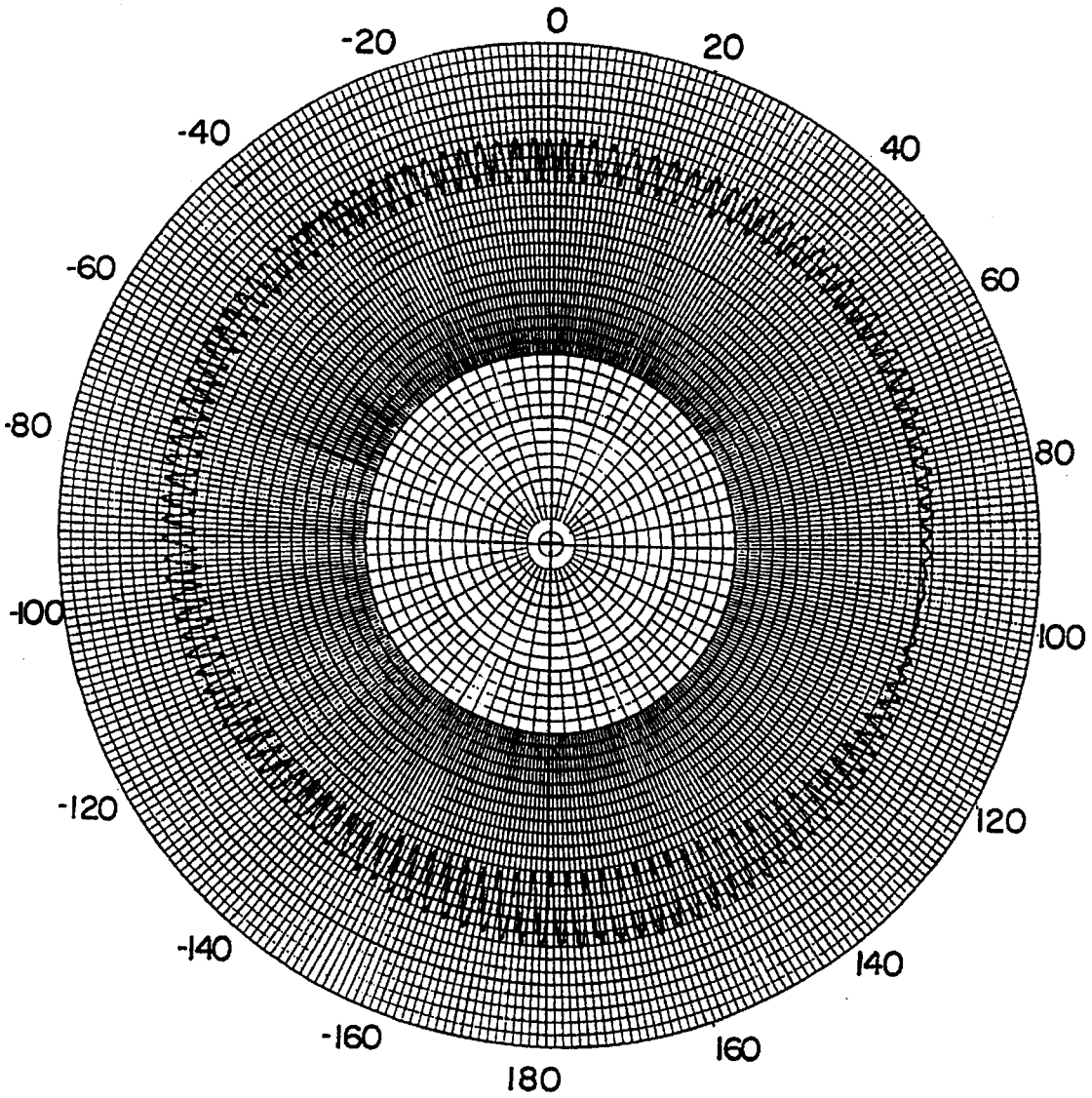
Figure 10:
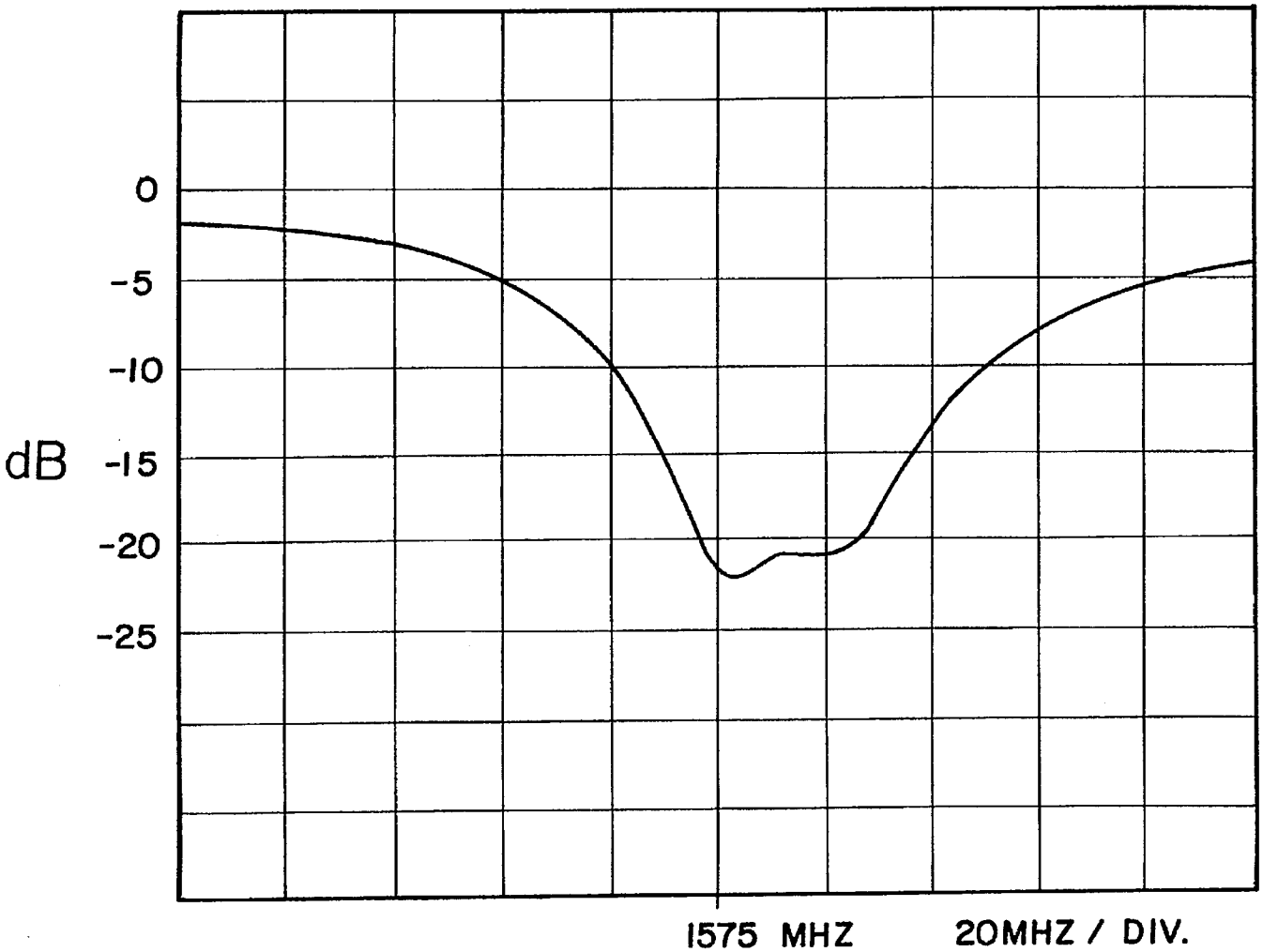

FIG. 8 illustrates the radiation pattern of an antenna built in accordance with the present invention, obtained in the elevational plane at an approximate frequency of 1575 Mhz. A seen by the pattern, the axial ratio is 1.8 db at zenith, and the maximum circular polarized gain is 2.1 dBic. FIG. 9 illustrates the 80 degree off zenith conic pattern of the same antenna, wherein the maximum gain is shown at 130 degrees having an axial ratio of 2.8 dB and a circular polarized gain of 3.3 dBic. Lastly, FIG. 10 illustrates the impedance and return loss for this antenna with a VSWR of 1.15:1. The above data indicates that the antenna of the present invention performs comparably with conventionally designed quadrifilars.

Furthermore, since the antenna is practically matched at 50 ohms around the two resonance frequencies, the feed line in association with the printed circuit technology does not necessitate any specific assembly for additional matching. This frees the antenna from the drawbacks of conventional quadrifilar antenna designs.

There has been described and illustrated herein, an improved quadrifilar antenna formed by printed circuit boards which can be relatively accurately formed and mass produced with predetermined shapes and dimensions, such that relatively little, if any, adjustment is required to obtain an antenna having high reproducibility of electromagnetic characteristics.

While particular embodiments of the invention have been described, it is not intended that the invention be limited exactly thereto, as it is intended that the invention be as broad in scope as the art will permit. The foregoing description and drawings will suggest other embodiments and variations within the scope of the claims to those skilled in the art, all of which are intended to be included in the spirit of the invention as herein set forth.

What is claimed is:

1. An antenna comprising:

a plurality of conductive elements, said plurality of conductive elements defining a plurality of helically twisted loops, said helically twisted loops each having a different electrical length and electrically connected to each other through a shared common segment; and an unbalanced transmission line having a first and a second conductor, said first conductor connected to a first end of a capacitor, said capacitor having a second end connected through a conductor to a tap point on at least one of said conductive elements and said second conductor connected to a midpoint of a common conductor section for performing impedance matching, electrical phasing, coupling and power distribution of said antenna.

2. An antenna according to claim 1, wherein said plurality of conductive elements includes four conductive elements arranged to define a first and second separate helically twisted loops, said first helically twisted loop differing in electrical length than said second helically twisted loop, said first and second helically twisted loops defining a cylinder of constant radius.

3. An antenna according to claim 2, wherein said plurality of conductive elements defining a plurality of helically twisted loops are supported on an outer surface of a generally elongated longitudinal non-conducting cylindrical substrate.

4. An antenna according to claim 2, wherein said four conductive elements arranged helically along a generally cylindrical longitudinal non-conductive substrate and supported by said substrate having a first printed circuit board for electrically connecting said four conductive elements at a first end of said substrate, said unbalanced transmission line is a second circuit board for electrically connecting said four conductive elements for performing both power distribution and impedance matching of said four conductive elements at a second end of said substrate.

5. An antenna according to claim 4, wherein said second printed circuit board having a first and second side, said first side defining a microstrip line and said second side defining a conducting ground plane, wherein said microstrip line and said ground plane are electrically coupled to each other to form a microstrip transmission line.

6. An antenna according to claim 5, wherein said ground plane on said second side of said second board terminates into a midsection of a generally rectangular portion, said rectangular portion defining a first set and a second set of connecting lines, each said set of said connecting lines being electrically connected to a respective one of said conducting elements wherein said first and said second set of said connecting lines having different electrical lengths thereby producing two different resonant frequencies.

7. An antenna according to claim 6, wherein said second side of said second board defining a first capacitive element separated from said rectangular portion and said second board defines a generally straight line terminating into a second capacitive element, wherein said first and said second capacitive elements form said capacitor.

8. An antenna according to claim 7, wherein said unbalanced transmission line comprises a feed line electrically connected to at least one of said conductive elements at said tap point and electrically connected to said first capacitive element at an opposite end, said feed line having a shape and position to impedance match said antenna, wherein said first capacitive element on said first side of said board electrically couples to said second capacitive element on said second side of said board, said first and said second capacitive element having predetermined dimensions for matching out said feed lines inductance.

9. An antenna according to claim 6, wherein said ground plane on said second side of said board inwardly tapers to said rectangular portion for bending said second printed circuit board away from said conductive elements and preventing interference with antenna radiation patterns.

10. An antenna according to claim 4, wherein said first printed circuit board having a first shorting line formed on one side of said first board and a second shorting line oppositely formed on an opposing side of said first board, said first shorting line being connected to a first set of two oppositely disposed conductive elements on said outer surface of said substrate and said second shorting line being connected to a second set of oppositely disposed conductive elements on said outer surface of said substrate.

11. An antenna according to claim 1, wherein said unbalanced transmission line comprises a coaxial transmission line wherein said first conductor is an inner conductor and said second conductor is an outer conductor.

12. An antenna according to claim 1, wherein said unbalanced transmission line comprises a microstrip transmission line.

13. An antenna comprising:

(a) a generally cylindrical longitudinal non-conductive substrate;

(b) four conductive elements arranged helically to define a cylinder of constant radius longitudinally along said substrate and supported by said substrate;

(c) a first printed circuit board for electrically connecting said conductive elements at a first end of said substrate and a second circuit board for electrically connecting said four conductive elements having a first and second side, said first side connected to a first end of a capacitor, said capacitor having a second end connected through a conductor to a nap point on at least one of said conductive elements and said second side connected to a midpoint of a common conductor section for performing both power distribution and impedance matching of said four conductive elements at a second end of said substrate.

14. An antenna according to claim 13, wherein said second printed circuit board having said first side defining a microstrip line and said second side defining a conducting ground plane, wherein said microstrip line and said ground plane are electrically coupled to each other to form a microstrip transmission line.

15. An antenna according to claim 14, wherein said ground plane on said second side of said second board terminates into a midsection of a generally rectangular portion, said rectangular portion defining a first set and a second set of connecting lines, each said set of said connecting lines being electrically connected to a respective one of said conducting elements wherein said first and said second set of said connecting lines having different electrical lengths thereby producing two different resonant frequencies.

16. An antenna according to claim 15, wherein said second side of said second board defining a first capacitive element separated from said rectangular portion and said first and said second set of said connecting lines, and said microstrip line on said first side of said second board defines a generally straight line terminating into a second capacitive element, wherein said first and said second capacitive elements form a parallel plate capacitor.

17. Art antenna according to claim 15, wherein said ground plane on said second side of said second board inwardly tapers to said rectangular portion for bending said second printed circuit board away from said conductive elements and preventing interference with antenna radiation patterns.

18. An antenna according to claim 16, wherein said second circuit board comprises a feed line electrically connected to at least one of said conductive elements at said tap point and electrically connected to said first capacitive element at an opposite end, said feed line having a shape and position to impedance match said antenna, wherein said first capacitive element on said first side of said board electrically couples to said second capacitive element on said second side of said board, said first and said second capacitive element having predetermined dimensions for matching out said feed lines inductance.

19. An antenna according to claim 13, wherein said first printed circuit board having a first shorting line formed on one side of said first board and a second shorting line oppositely formed on an opposing side of said board, said first shorting line being connected to a first set of two oppositely disposed conductive elements on said outer surface of said substrate and said second shorting line being connected to a second set of oppositely disposed conductive elements on said outer surface of said substrate.

20. An antenna comprising:

(a) a generally cylindrical longitudinal non-conductive substrate having a first and second end;

(b) four conductive elements arranged helically to define a cylinder of constant radius longitudinally along said substrate and supported by said substrate;

(c) a first printed circuit board having microstrip lines formed on a first and second side of said first board, said microstrip line on said first side comprises a ground plane terminating into a generally rectangular portion, said rectangular portion having a first set and second set of connecting lines, each said connecting line being electrically connected to respective one of said conducting elements on a first end of said substrate, said first set of said connecting lines having different electrical lengths than said second set of said connecting lines;

(d) said first side of said first board having a first capacitive element separated from said rectangular portion and said first and said second set of said connecting lines, said microstrip line on said second side defining a generally straight line terminating into a second capacitive element, said first and said second capacitive elements forming a parallel plate capacitor;

(e) a feed line supported by said substrate and electrically connected to at least one of said conductive elements at a tap point and electrically connected to said first capacitive element at an opposite end, said feed line having a shape and position to impedance match said antenna, wherein said first capacitive element electrically couples to said second capacitive element on said second side of said board, and wherein said first and said second capacitive element having predetermined dimensions for matching out an inductance of said feed line; and (f) a second printed circuit board having a first shorting line formed on one side of said second board and a second shorting line oppositely formed on an opposing side of said board, said first shorting line being connected to a first set of two oppositely disposed conductive elements on said outer surface of said substrate and said second shorting line being connected to a second set of oppositely disposed conductive elements on said outer surface of said substrate.

* * * * *